US005164689A

United States Patent [19]

Plonka

[11] Patent Number: 5,164,689

[45] Date of Patent: Nov. 17, 1992

[54] N-WAY POWER COMBINER/DIVIDER

[75] Inventor: Robert J. Plonka, Quincy, Ill.

[73] Assignee: Harris Corporation, Melbourne, Fla.

[21] Appl. No.: 684,024

[22] Filed: Apr. 11, 1991

[51] Int. Cl.[5] ..... H01P 5/12

[52] U.S. Cl. ..... 333/128; 333/246

[58] Field of Search ..... 333/125, 127, 128, 136

[56] References Cited

U.S. PATENT DOCUMENTS

| | | | |
|---|---|---|---|
| 3,529,265 | 9/1970 | Podell | 333/127 |
| 4,163,955 | 8/1979 | Iden et al. | 333/127 |
| 4,174,506 | 11/1979 | Ogawa | 333/1.1 |
| 4,901,042 | 2/1990 | Terakawa et al. | 333/127 |

FOREIGN PATENT DOCUMENTS

| | | | |
|---|---|---|---|
| 232502 | 9/1988 | Japan | 333/128 |

*Primary Examiner*—Paul Gensler

*Attorney, Agent, or Firm*—Tarolli, Sundheim & Covell

[57] ABSTRACT

There is presented herein an N-way power combiner/-divider and which includes a common output/input port, a plurality of N input/output ports together with N load ports. N transmission lines interconnect the common output/input port with the N input/output ports. A second plurality of N transmission lines interconnect the respective input/output ports with respective ones of the N load ports. Also, a third plurality of N transmission lines interconnect each of the load ports with a common point and which is, in turn, connected to ground by a capacitor. A first plurality of transmission lines and a second plurality of transmission lines include a plurality of metal foil traces respectively mounted on first and second insulator boards which are spaced from each other. At least three metal layers are provided which are electrically connected together and which serve as ground planes. These layers are spaced from and are parallel to the insulator boards such that the first insulator board is located between the first and second metal layers and the second insulator board is located between second and third metal layers. N electrical connecting pins are provided with each located at one of the N input/output ports. These pins extend between the first and second boards for electrically interconnecting transmission lines on different insulator boards.

13 Claims, 8 Drawing Sheets

N-WAY POWER COMBINER/DIVIDER

FIELD OF THE INVENTION

This invention relates to the art of RF power combiner/divider circuits for use in combining or dividing RF signals.

BACKGROUND OF THE INVENTION

U. H. Gysel of the Stanford Research Center disclosed a device in his paper entitled "A New N-Way Power Divider/Combiner Suitable for High Power Amplifications" which appeared in the proceedings of the 1975 M.T.T. Symposium in Palo Alto, Calif. The Gysel device is discussed in the introduction of the U.S. Pat. No. to F. W. Iden 4,163,955. Iden pointed out that the Gysel device offered external isolation loads (high power load resistors) and monitoring capability for imbalances at the output/input ports and, as such, is an improvement over another prior art combiner/divider known as the Wilkinson device. Iden pointed out that Gysel offered no means for practical realization of his device other than pointing out that its construction could take the form of either stripline, slabline or microstrip.

Iden, in his patent, stated that an attempt to implement the Gysel device resulted in a sandwich-type structure employing stripline to provide the required quarter wavelength transmission lines. This was apparently realized on a Teflon board in microstrip form. Apparently, two separate boards were used and, through connections, necessitated by the topology of the design, were made with one millimeter bolts. The foregoing description, found in the Iden patent, does not present a disclosure of how the two boards are interconnected or whether or not the boards are parallel to each other or whether they are oriented in an over and under layered three dimensional arrangement. Iden's patent presents a modification of the Gysel circuit with a radial cylindrical structure which appears quite awkward from the standpoint of size and assembly. It is believed that a five kilowatt 100 MHz application of the Iden structure for a five-way combining system would require an assembly of over six feet tall. Moreover, the Gysel modified circuit presented by the Iden patent requires substantial use of coaxial cable interconnections including interconnections to external loads that are vital to circuit performance.

It has been determined that by implementing a Gysel type circuit in a three dimensional layered structure, one may provide high power handling capability in a mechanically compact unit. For example, a five kilowatt 100 MHz application for a five-way combining system could be assembled as a layered three dimensional structure having dimensions on the order of two feet square and less than one foot thick. Moreover, such a device could take the form of a complete combiner assembly having reject loads as an integral assembly.

Moreover, a Gysel type circuit as discussed in the Iden patent has a relatively narrow bandwidth for acceptable input port return loss operation. It is therefore desirable to improve upon the Gysel device in such a way as to increase its bandwidth performance so that relatively good impedance matching may take place over a bandwidth over a range from, for example, 87.5 MHz to 108 MHz.

SUMMARY OF THE INVENTION

In accordance with one aspect of the present invention, an improved N-way power combiner/divider is provided having a three dimensional layered assembly and in which the combiner/divider includes a common output/input port and a plurality of N input/output ports. A plurality of N first transmission lines are provided with each having a first end connected in common to the common output/input port and each having its second end connected to a respective one of the N input/output ports. Also, a plurality of N second transmission lines are provided with each having a first end connected to a respective one of the N input/output ports. The N first transmission lines respectively include N coplanar first metal traces mounted on a first insulator board whereas the N second transmission lines include N coplanar second metal traces mounted on a second insulator board. These boards are spaced from each other in overlapping parallel planes. There is also provided first, second and third metal planar layers electrically connected together and serving as ground planes. These planar layers are spaced from and are parallel to the first and second insulator boards such that the first insulator board is located between the first and second layers and the second insulator board is located between the second and third layers. N electrical connector means, each located at one of the N input/output ports, serve to extend between the first and second boards for purposes of electrically connecting a respective second end of a first transmission line with a first end of one of the second transmission lines.

Still further in accordance with another aspect of the present invention, there is provided an N-way power combiner/divider which includes a common output/input port together with N input/output ports and N load ports. Additionally, this combiner/divider includes N first transmission lines each having a first characteristic impedance $Z_1$ and each having a first end connected in common to the common output/input port with each opposite second end connected to a respective one of the N input/output ports. N second transmission lines are provided with each having a second characteristic impedance $Z_2$ and with each having a first end connected to a respective one of the N input/output ports and each connected at its opposite second end to a respective one of the N load ports. This combiner/divider also includes N third transmission lines each having a third characteristic impedance $Z_3$ and each having a first end connected to a respective one of the N load ports and each having its second end connected to a common point. A reactance means, such as a capacitor, connects the common point to electrical ground.

BRIEF DESCRIPTION OF THE DRAWINGS

The foregoing and other objects of the invention will become more readily apparent from the following description of the preferred embodiment of the invention as taken in conjunction with the accompanying drawings which are a part hereof and wherein.

DESCRIPTION OF PREFERRED EMBODIMENT

Figure 1:
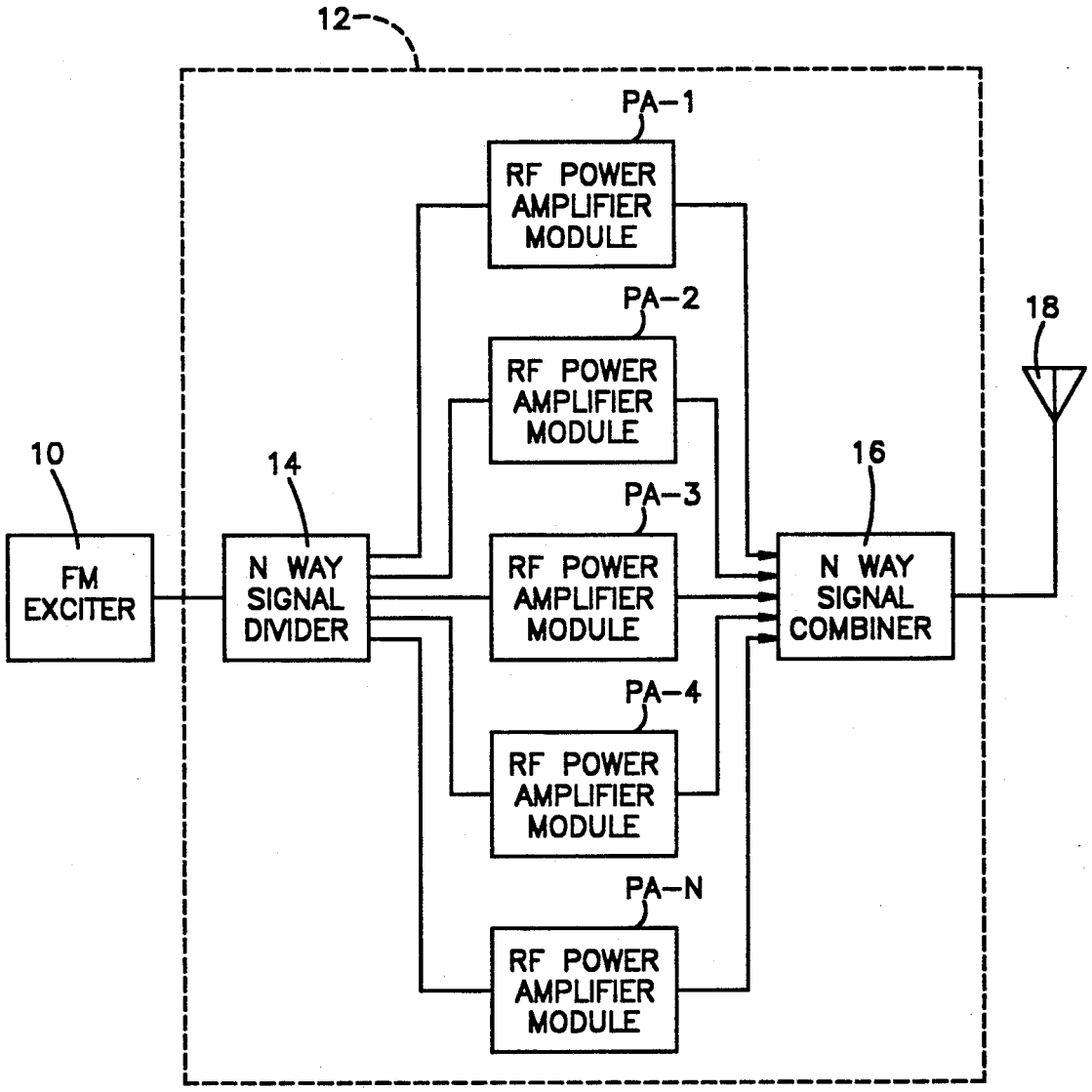
FIG. 1 is a schematic-block diagram illustration of one application of the present invention.

Reference is now made to FIG. 1 which illustrates one application of the present invention in an RF transmitting system. Such a system employs an FM signal generator frequently referred to in the art as an FM exciter 10 together with an FM transmitter 12. The FM exciter 10 may produce a radio frequency signal in the FM range from 87.5 MHz to 108 MHz at a power level on the order of 25 watts. It is frequently desirable that the transmitted signal be boosted in power to, for example, five kilowatts. Solid state power amplifiers may be employed for increasing the power. There are limitations in the power handling capability of such amplifiers. It is for this reason that it is common to divide the signal to be amplified into several paths, each of which includes an RF power amplifier operating at a level of, for example, 1 kw. The amplified signals are then combined and transmitted as with an antenna. Such a system is illustrated in FIG. 1 wherein the output from the FM exciter 10 is supplied to an N-way signal divider 14 which then divides the signal into N paths applying each portion of the split signal to an RF power amplifier PA-1 through PA-N. In the example illustrated, each power amplifier may boost the power to 1 kw where N is equal to 5. The amplified signals are then supplied to an N-way signal combiner 16 to produce the final output signal at a power level on the order of 5 kw, which is then applied to the transmitting antenna 18. The signal divider 14 and the signal combiner 16 may each be constructed in the same manner. Moreover, the signal combiner/divider to be described herein can be employed as either a signal divider 14 or as a signal combiner 16. In the embodiment to be described, the signal combiner/divider is employed herein as a combiner 16 and will be referred to hereinafter as such.

Figure 2:
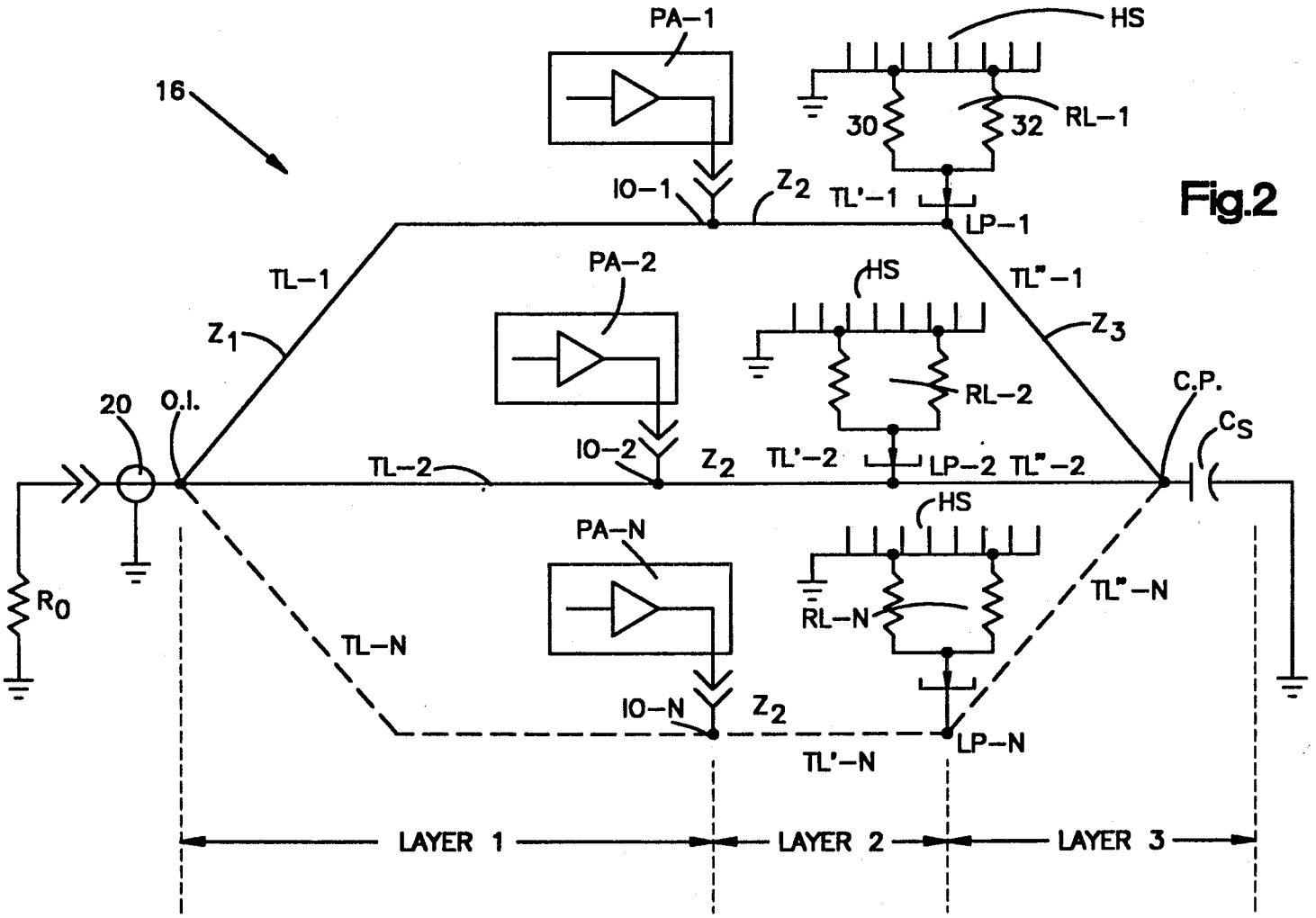
FIG. 2 is a schematic-block diagram illustration of an electrical circuit diagram of a combiner/divider constructed in accordance with the present invention.

Reference is now made to FIG. 2 which schematically illustrates the combiner/divide circuit constructed in accordance with the present invention. This is an N-way high power RF combiner/divider and, as illustrated in FIG. 2, it includes a common output/input port OI together with a plurality of N input/output ports IO-1 through IO-N, a like plurality of N load ports LP-1 through LP-N as well as a common point CP, to be described hereinafter.

The common output/input port OI is connected to each of the input/output ports IO-1 through IO-N by one of a plurality of transmission lines TL-1 through TL-N, each having a characteristic impedance of $Z_1$ and each having a length on the order of one quarter wavelength at the operating frequency of the combiner/divider. The input/output ports IO-1 through IO-N are interconnected with corresponding load ports LP-1 through LP-N by respective transmission lines TL'-1 through TL'-N, each exhibiting a characteristic impedance of $Z_2$ and each having a length on the order of one quarter wavelength at the operating frequency of the combiner/divider. Moreover, the load ports LP-1 through LP-N are respectively connected to the common point CP by transmission lines TL''-1 through TL''-N each exhibiting a characteristic impedance of $Z_3$ and wherein each has a length on the order of one quarter wavelength at the operating frequency of the combiner/divider. A reactance, in the form of a capacitor $C_s$, interconnects the common point CP with electrical ground. It has been determined for one operating version of the invention herein that the capacitance of the capacitor $C_s$ may be on the order of 30.0 pf (picofarads).

The combiner/divider of FIG. 2 is employed herein as an N-way signal combiner 16 and as such the input/output ports are utilized as input ports and the common output/input port is employed as an output port. The input to the combiner is taken from the power amplifiers PA-1 through PA-N which are shown as being directly plugged into the input/output ports IO-1 through IO-N. Also, the load is shown as a resistor $R_o$ connected to the center connector of a coaxial cable 20 and thence to transmission lines TL-1 to TL-N.

The circuit further includes a plurality of reject loads RL-1 through RL-N respectively connected to the load ports LP-1 through LP-N. As will be appreciated in greater detail hereinafter, the reject loads RL-1 through RL-N are connected to a common heat sink HS and which, in turn, is connected to electrical ground. Each of the reject loads RL-1 through RL-N includes a pair of resistors 30 and 32 connected together in parallel. Each of these resistors may be on the order of 100 ohms so that each reject load is on the order of 50 ohms.

The circuit described thus far in FIG. 2 differs from the Gysel circuit described in FIG. 1 of the Iden et al. U.S. Pat. No. 4,163,955 primarily in the following manner. The Gysel circuit has a floating center point and does not include a compensating reactance connecting the center point to ground as in FIG. 2 herein. Moreover, Gysel's circuit employs an output matching line which would be connected in FIG. 2 between what is shown as the output/input port OI to the resistor load $R_0$. With these modifications being made to the Gysel circuit, improved performance has been accomplished. Specifically, the addition of capacitor $C_s$ along with the impedance of the reject loads RL-1 through RL-N and careful selection of the interconnecting impedances $Z_1$, $Z_2$, and $Z_3$ and their respective line lengths, normally about 0.25 wavelengths, form the basis of enhanced performance. This enhanced performance has resulted in increased bandwidth and improved input port return loss. This is presented in FIGS. 3 and 4 to be discussed below.

Figure 3:
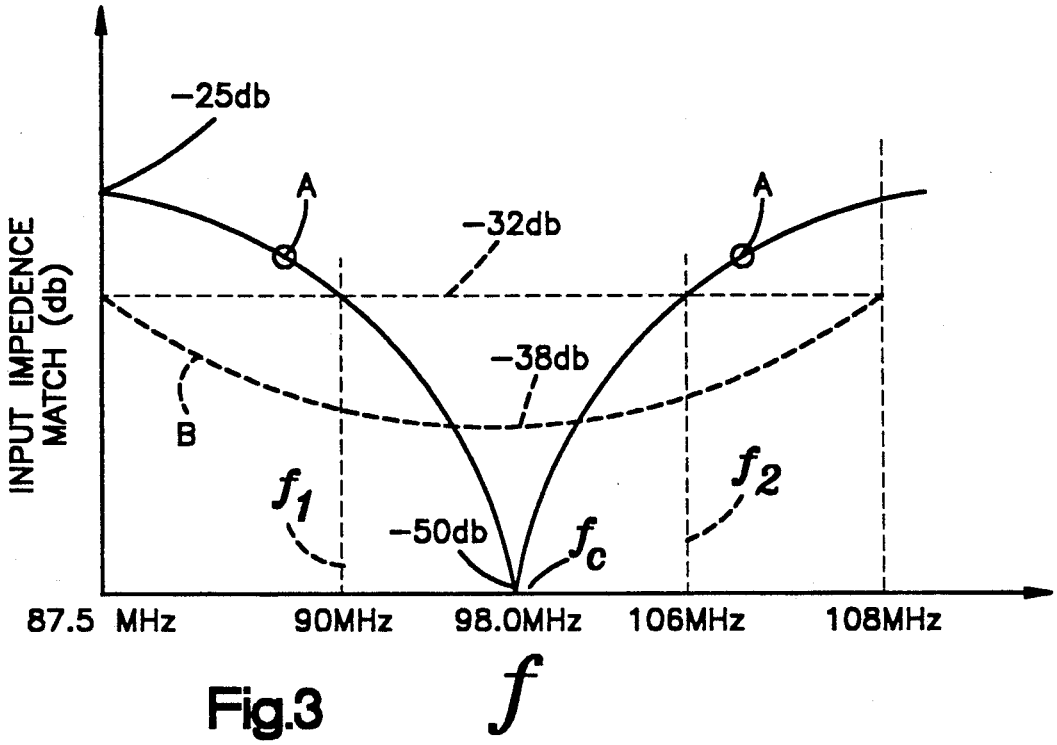
FIG. 3 is a graphical illustration representative of impedance match with respect to frequency which is helpful in describing the operation of the circuit of FIG. 2.

Reference is now made to FIG. 3 which is a graphical illustration of input impedance match in decibels (db) against frequency over the FM frequency band of from 87.5 MHz to 108 MHz. This graphical illustration depicts the operation of the Gysel circuit in the solid curve A against the operation of the circuit of FIG. 2 herein as curve B. The example is given with respect to a center frequency $F_c$ on the order of 98.0 MHz. This example picks an impedance match level on the order of −32 db as a point separating a good impedance match from a bad impedance match with a good impedance match being shown below the −32 db level. From this example, it is seen that the Gysel circuit has a good impedance match over a relatively narrow bandwidth from frequency F1 to frequency F2, such as from approximately 90 MHz to 106 MHz. Using the same example, the circuit of FIG. 2 provides a good impedance match over a wider bandwidth, such as the entire FM range from 87.5 MHz to 108 MHz, as is seen from curve B. At the center frequency $F_c$, curve B shows a performance of approximately −38 db return loss as opposed to the Gysel circuit's return loss of −50 db on curve A. However, curve B does show that acceptable performance is achieved with the circuit of FIG. 2 for a substantially wider frequency band.

Figure 4:
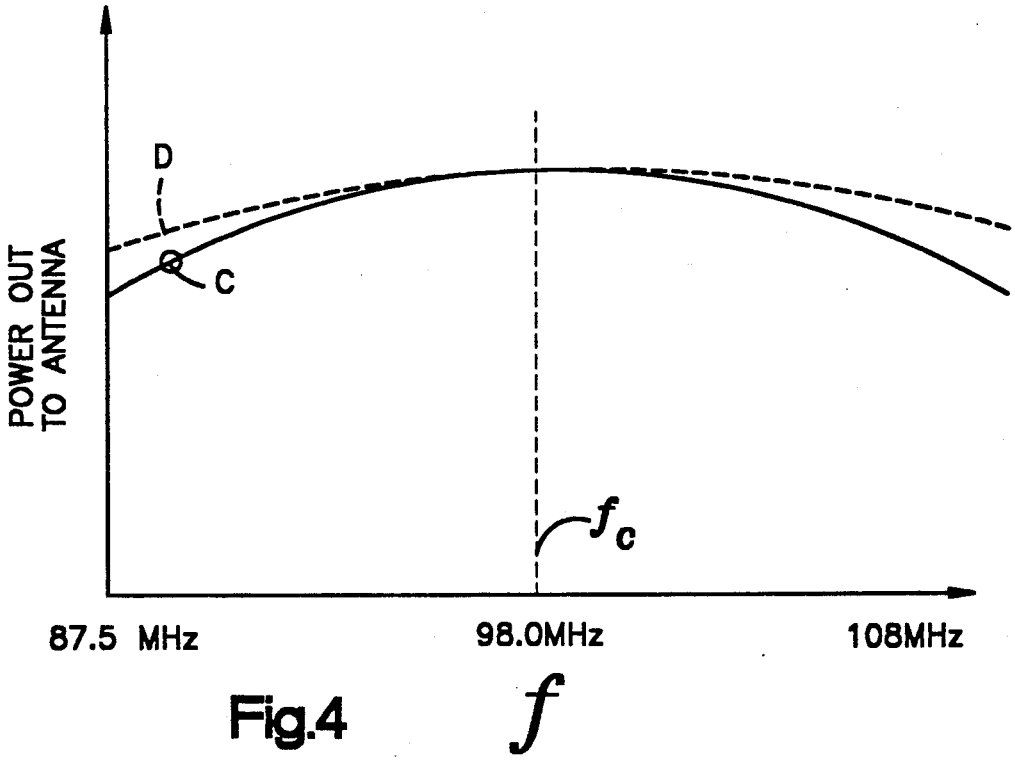
FIG. 4 is a graphical illustration of power out to the antenna as a function of frequency and which is helpful in describing the operation of the circuit illustrated in FIG. 2.

Reference is now made to FIG. 4 which shows two curves C and D respectively representing the operation of the Gysel circuit and the circuit of FIG. 2 herein with respect to power out to the antenna over the frequency band from 87.5 MHz to 108 MHz. From this curve, it is seen that the maximum power out to the antenna for both circuits takes place at the center frequency $F_c$ with the performance decaying somewhat at the outer ends of the frequency band. The performance of the circuit in accordance with FIG. 2, as shown by the dotted lines of curve D, is better in terms of power out to the antenna at the ends of the frequency band.

Layered Implementation

As will be brought out in greater detail hereinafter with respect to FIGS. 5 through 9, the combiner/divider of FIG. 2 is preferably implemented herein as a compact layered assembly employing suspended stripline techniques with an air gap above and below the stripline substrate for high power capability. The construction features an integral circuit matched reject load assembly for high port-to-port isolation. The system is essentially structured as a flat box permitting N RF power amplifiers (or modules) to be plugged directly into the assembly without the need for interconnecting coaxial cables as is common in the prior art. It is typical in the prior art that coaxial cables are employed to connect a combiner to a plurality of RF power amplifiers (or modules) as well as to a plurality of reject loads. The implementation of the circuit of FIG. 2 provides direct plug in of the power amplifiers PA-1 through PA-N to the input/output ports IO-1 through IO-N as well as an integral connection between the reject loads RL-1 through RL-N with the load ports LP-1 through LP-N.

The layered assembly herein is a three dimensional structure that allows several degrees of freedom in selecting the interlayer stripline impedances for best optimization of combiner parameters. The three dimensional approach employed herein permits stacking various stripline sections corresponding, for example, with layers 1, 2 and 3 of FIG. 2, with these layers being over and under each other with interconnecting points penetrating several layers as required. The stacked arrangement leads to a compact high power assembly that is particularly adaptable to the VHF and UHF frequency bands where the longer wavelengths normally lead to a large signal combining structure.

Figure 5:
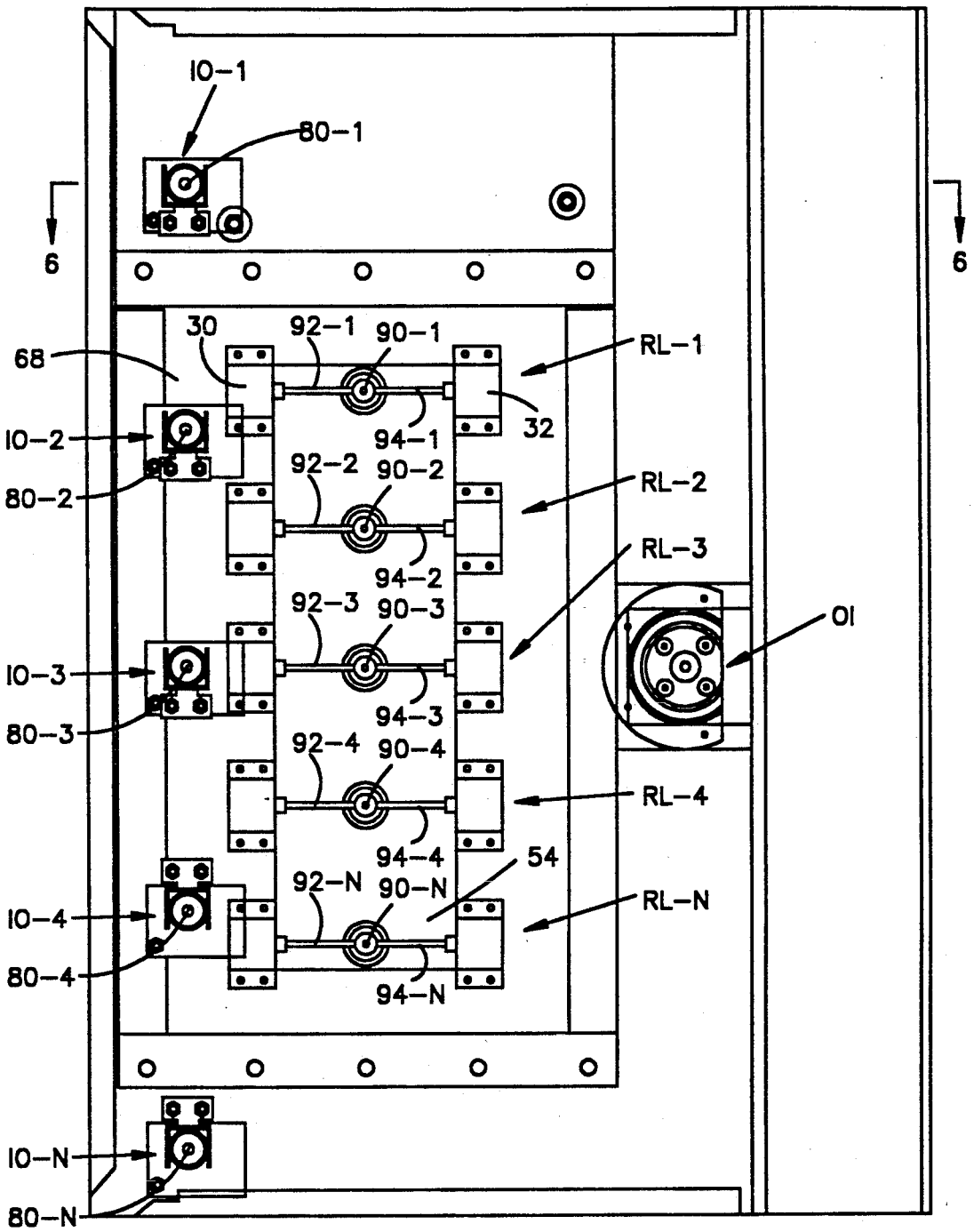
FIG. 5 is a plan view of the electro-mechanical construction of combiner/divider in accordance with the invention herein and wherein the view is taken generally along line 5—5 looking in the direction of the arrows in FIG. 6.
Figure 6:
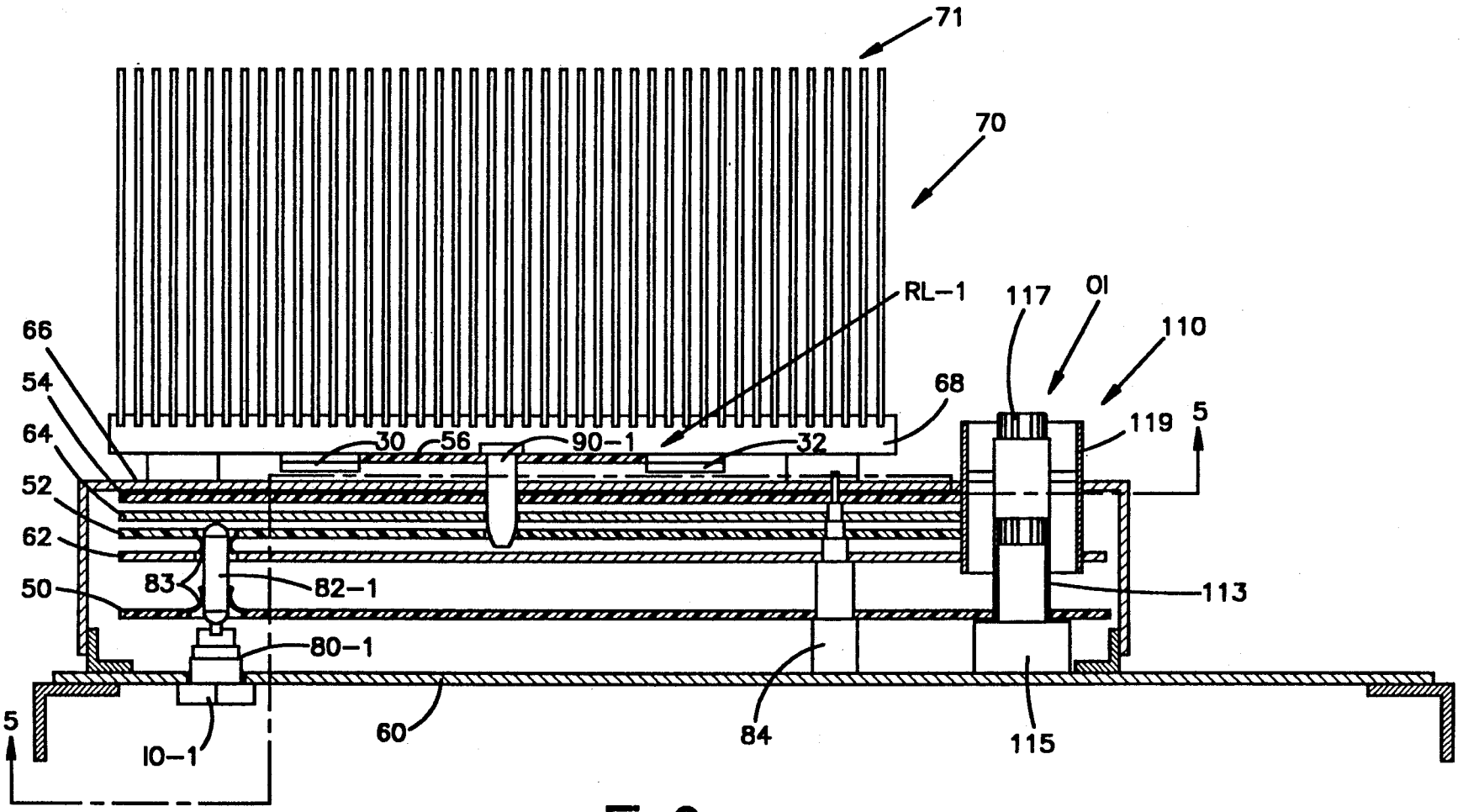
FIG. 6 is a top view partly in section taken generally along line 6—6 looking in the direction of the arrows in FIG. 5.

The layered assembly of the combiner/divider herein is illustrated in greater detail in FIGS. 5 through 9 to which attention is now directed. The structure is depicted in FIGS. 5 and 6 and it includes insulator boards 50, 52 and 54 and a fourth insulator board 56. Insulator boards 50, 52 and 54 are respectively illustrated in FIGS. 7, 8 and 9, to be discussed hereinafter. Each insulator board corresponds to one of the layers referred to in FIG. 2. Thus, insulator boards 50, 52 and 54 respectively correspond with layers 1, 2 and 3. Insulator board 56 may be considered as corresponding with a layer 4 and which serves to connect the reject loads RL-1 through RL-N to the layered assembly, as will be appreciated hereinafter.

In addition to the insulator boards 50, 52, 54 and 56, the layered assembly (FIG. 6) also includes metal sheets or layers 60, 62, 64 and 66 which serve as ground planes located above and below respective insulator boards. Additionally, the base 68 of a heat sink 70, to be discussed in greater detail hereinafter, can serve as a ground plane along with plate 66 on either side of the insulator board 56. Each of the insulator boards carries a plurality of metal traces and these traces, in conjunction with the associated ground planes, define suspended striplines with interleaving air gaps between the supporting insulator boards and the over and under metal ground planes permitting high power operation with the inherent ventilation capability of a layered assembly. Moreover, as will be brought out hereinafter, the layered suspended striplines can be accurately set to the correct optimized impedance levels by controlling the width of the metal traces as well as the spacing between the traces and the associated over and under ground planes.

The input/output ports IO-1 through IO-N for receiving the power amplifier modules PA-1 through PA-N are illustrated in FIG. 5. As is shown in FIG. 6 with respect to port IO-1, each of these ports includes a conventional coaxial connector 80 mounted to the metal plate 60 for receiving a coaxial input from a power amplifier. The center conductor of each coaxial connector 80 is connected to a pin 82-1 which serves to electrically connect together one end of a transmission line on board 50 with one end of a transmission line on board 52. Spring finger clips 83 electrically and resiliently interconnect pin 82-1 with the transmission lines on boards 50 and 52. Since there are N input/output ports, there are N connecting pins 82-1 through 82-N for this function. Thus, connecting pins 82-1 through 82-N interconnect with the central conductor of the coaxial connectors 80-1 through 80-N, respectively, to make electrical contact with the appropriate transmission terminations at the input/output ports IO-1 through IO-N.

The various insulator boards and the metal ground planes are separated from each other by air gaps which, together with the width of the metal traces on the boards, determine the impedances of the transmission lines. The spacing between the layers may be controlled as with a stepped spacer 84 of which one is illustrated in FIG. 6. Preferably, several such spacers are employed for maintaining the appropriate spacing between the various insulator boards and ground planes.

As can be seen from FIG. 2, each of the reject loads RL-1 through RL-N is electrically connected to a respective one of the load ports LP-1 through LP-N.

Each reject load RL-1 through RL-N has an associated electrical connecting pin 90-1 through 90-N. The pins electrically connect a reject load with an associated transmission line termination at the respective load ports LP-1 through LP-N. Thus, for example, at the load port LP-1, one end of a transmission line TL'-1 on layer 2 (insulator board 52) must be electrically interconnected with the corresponding termination end of transmission line TL''-1 which is located on layer 3 (insulator board 54). The electrical connecting pin 90-1 interconnects the reject load RL-1 with transmission line traces located on insulator boards 52 and 54 while being electrically spaced from the metal ground planes 64 and 66. Corresponding electrical connections are made at the other load ports LP-2 through LP-N.

Reference is now made to FIGS. 5 and 6 which illustrate the insulator board 56 which is mounted to the heat sink base 68 and which carries the reject loads RL-1 through RL-N. As is seen in FIGS. 2 and 5, each reject load, such as reject load RL-1, include resistors 30 and 32. One end of each resistor is electrically connected to ground through the base 68 of the heat sink HS. The other ends of the resistors 30 and 32 are respectively connected by metal foil traces 92-1 and 94-1 to the load port LP-1. The connecting pin 90-1 interconnects the metal foil traces 92-1 and 94-1 together as well as to the transmission line terminations at the load port LP-1. In a similar manner, metal foil traces 92-2 through 92-N and 94-2 through 94-N interconnect the resistors 30 and 32 of reject loads RL-2 through RL-N with the connecting pins 90-2 through 90-N.

Figure 7:
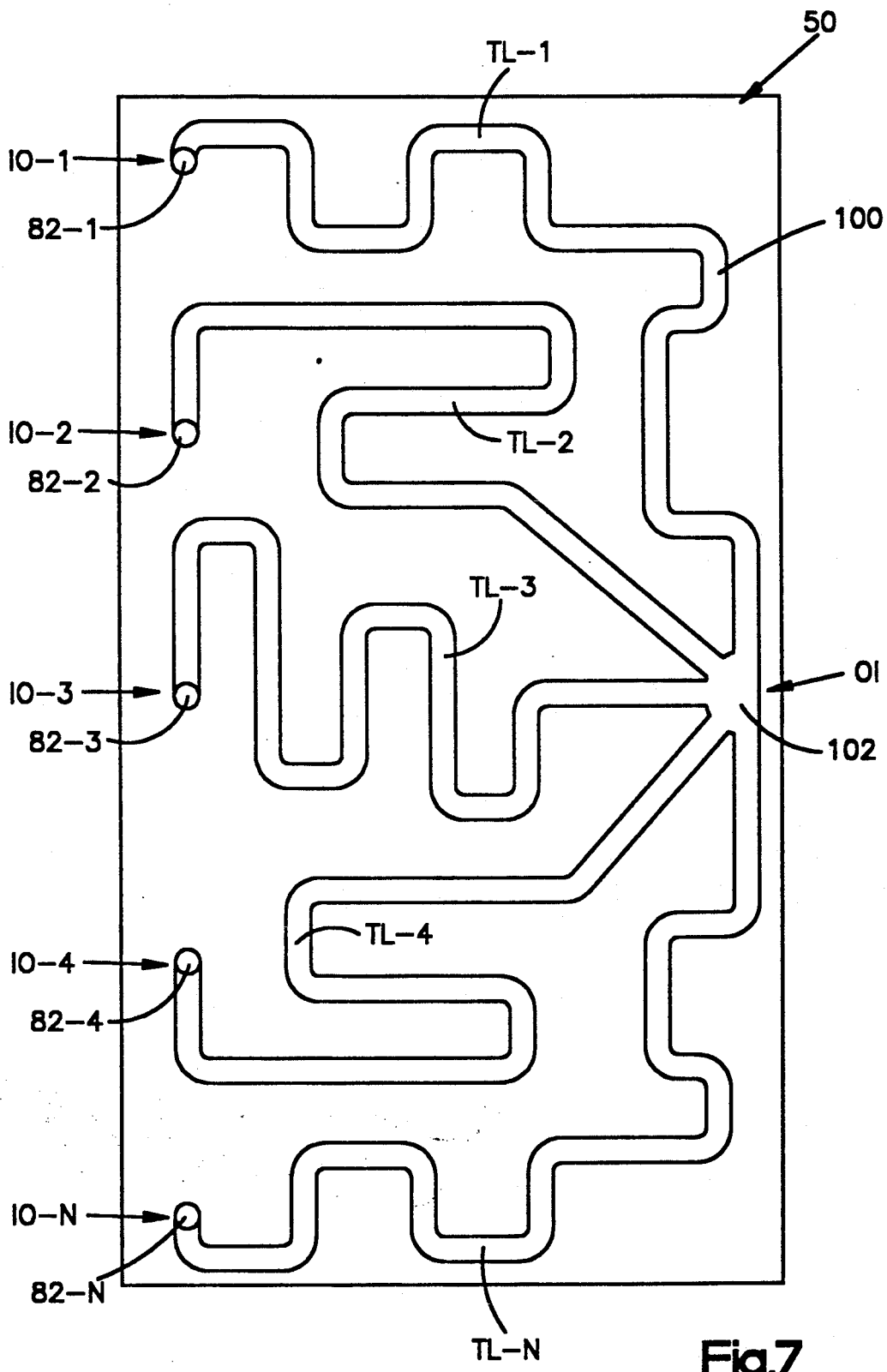
FIG. 7 is a plan view showing first insulator board carrying coplanar metal traces thereon.
Figure 8:
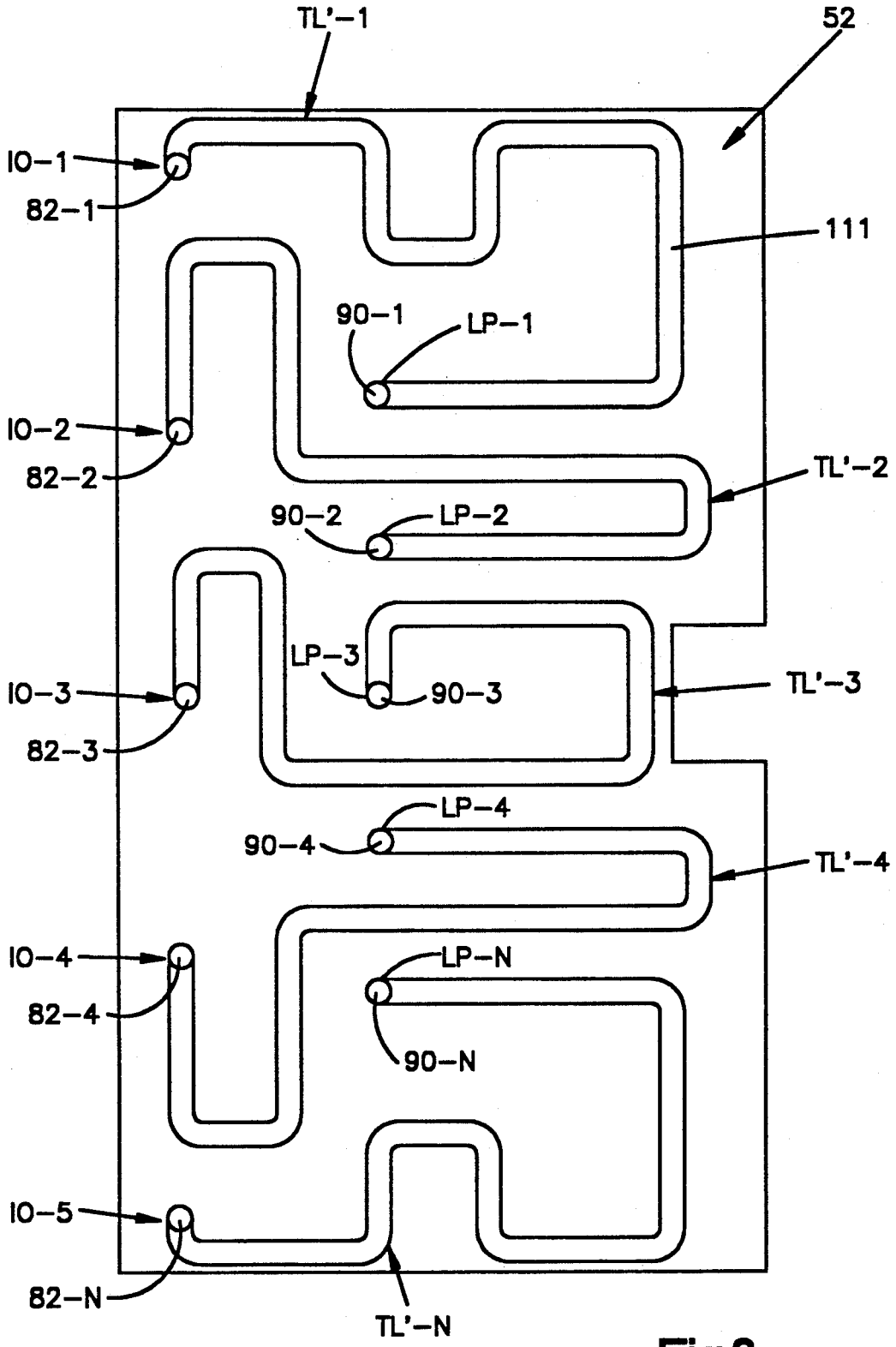
FIG. 8 is a view similar to that of FIG. 7, but showing another arrangement of coplanar metal traces mounted on a second insulator board.
Figure 9:
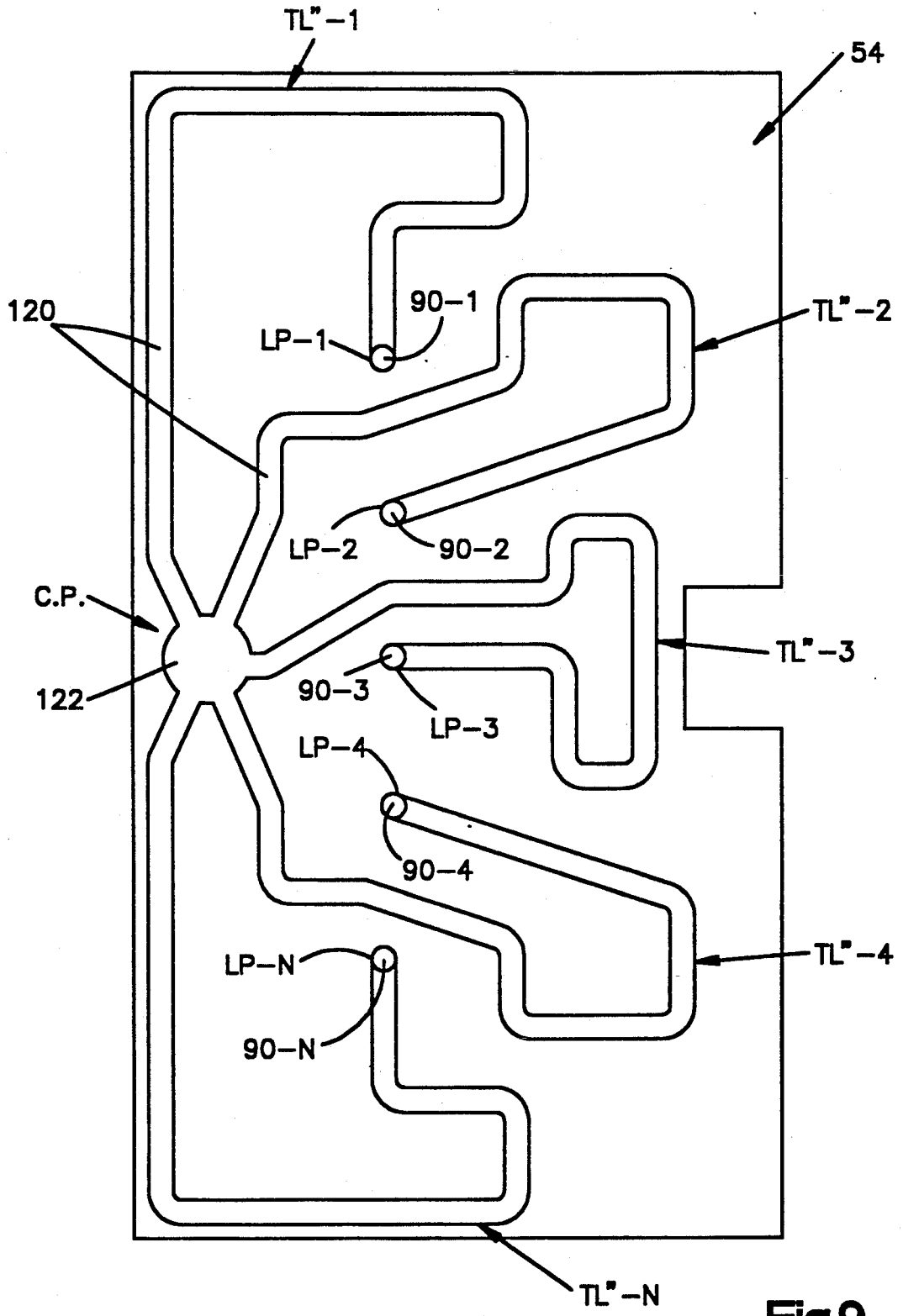
FIG. 9 is a view similar to that of FIGS. 7 and 8, but showing a third pattern of metal traces mounted on a third insulator board.

Before describing the electro-mechanical features of the common output/input port OI and the common point CP which is connected by a capacitor $C_s$ to ground, attention is directed to FIGS. 7, 8 and 9, which respectively illustrate the insulator boards 50, 52 and 54, together with the metal traces thereon.

Turning now to FIG. 7, there is illustrated an insulator board 50 and which is incorporated in layer 1 of FIG. 2 with the insulator board having metal traces 100 thereon defining the patterns as illustrated in FIG. 7. These traces, together with associated ground planes define suspended striplines which. are the preferred implementation of the transmission lines TL-1, TL-2, TL-3, TL-4 and TL-N. Each of these metal traces has a common termination at the output/input port OI where the traces are electrically interconnected with a metal foil patch 102. This metal foil patch is connected to the center conductor of a coaxial connector 110 to be described hereinafter. The other end of each metal foil trace serves as a transmission line termination at the input/output ports IO-1, IO-2, IO-3, IO-4, and IO-N. These terminations of the transmission lines TL-1 through TL-N are electrically connected to associated terminations of transmission lines TL'-1 through TL'-N of board 52 by electrical connecting pins 82-1 through 82-N.

Reference is now made to FIG. 8 which illustrates the insulator board 52 having a pattern of metal foil traces 111 thereon with each of these traces having a length on the order of one-quarter wave length at the operating frequency of the combiner/divider. Each of these traces has an input/output port termination and a load port termination. The input/output terminations are at ports IO-1 through IO-N. These terminations are interconnected with transmission lines TL-1 through TL-N on board 50 (FIG. 7) by the respective electrical connecting pins 82-1 through 82-N.

The terminations at the opposite ends of transmission lines TL'-1 through TL'-N are interconnected with corresponding terminations of transmission lines TL''-1 through TL''-N on insulator board 54 (FIG. 9) by means of respective electrical interconnecting pins 90-1 through 90-N.

Reference is now made to FIG. 9 which illustrates insulator board 54 and which carries a pattern of metal foil traces 120 which together with over and under ground planes define suspended striplines employed herein as transmission lines TL''-1 through TL''-N These transmission lines have respective common ends electrically connected together with a foil patch 122, which serves as one plate of the capacitor $C_s$ at the common point CP (FIG. 2). The other end of each transmission line terminates at a respective one of the load ports LP-1 through LP-N. These terminations are electrically connected to the corresponding terminations of transmission lines TL'-1 through TL'-N by means of the electrical interconnecting pins 90-1 through 90-N, respectively. The capacitor $C_s$ is defined by the metal foil patch 122 together with the above and below ground planes 64 and 66 with the area of the patch and the spacing from the ground planes being adjusted to attain the capacitance desired.

The common output/input port OI is best illustrated in FIGS. 2 and 6 and serves to connect a common termination of the transmission lines TL-1 through TL-N with a center conductor of a coaxial cable. The coaxial cable connector 110 is of conventional design and includes a central upstanding copper pipe 113 which is carried by an insulator 115 and is electrically interconnected with the common metal foil patch 102 (FIG. 7) at the output/input port OI. The pipe 113 carries an extension known as a bullet 117 which is coaxially surrounded by an outer sleeve 119. Bullet 117 serves to make engagement, in a conventional manner, with the inner conductor of a coaxial cable and the outer sleeve 119 serves to make electrical contact with the outer conductor of a coaxial cable. Sleeve 119 is carried by and electrically connected to ground planes, such as the metal layers 62 and 66.

Reject Load and Heat Sink Assembly

The reject loads RL-1 through RL-N together with the heat sink 70 may be considered as an integral assembly which serves as a plug-in unit. Thus, the interconnecting electrical pins 90-1 through 90-N plug into the layered assembly such that the pins make electrical contact with the appropriate transmission line terminations at the load ports LP-1 through LP-N. In the example presented herein, N=5 and, consequently, there are five reject loads mounted on a combination of the insulator board 56 and the adjacent surface of heat sink base 68. Also attached to the heat sink base and extending in a direction away from the layered assembly is a plurality of aluminum fins 71 which serve to dissipate heat in a known manner.

Typically, in a multi-port combiner, each load port, is provided with a reject load. The reject load serves as a load for power that is being rejected when an imbalance takes place in the combiner, such as from deactivating one or more of the power amplifiers PA-1 through PA-N by either disconnecting the power amplifier or upon its failure. Since one never knows which load port will require cooling, it has been typical to design for the worst case situation for each port. Normally, this has meant that there are N heat sinks and excessive air for cooling to handle the N reject loads, such as reject loads RL-1 through RL-N in FIG. 2.

As will be brought out hereinafter, the present invention permits use of such a combiner with a common heat sink coupled to all of the N reject loads with the heat sink being configured to dissipate the heat resulting from the deactivation of more than one of N RF power amplifiers. This permits a single heat sink to be used for cooling the reject loads under all combinations of deactivating one or more of the power amplifiers. This will be more readily understood from the discussion that follows below.

It has been determined that the total dissipated power of an N-way zero phase combining system follows the formula presented below when one or more RF power amplifiers, such as amplifiers PA-1 through PA-N, are removed or deactivated.

$$Pd = Pm(n - x)\left(1 - \frac{(n - x)}{n}\right) \quad (1)$$

where:

Pd=total reject load dissipation in watts
Pm=RF amplifier output power in watts
n=total number of RF amplifiers
x=number of RF amplifiers deactivated Assume that x=1 deactivated or removed power amplifiers in a system wherein n=5, defining a five-way combining system using power amplifiers each providing 1 kw power. In such case, the reject load corresponding to the deactivated power amplifier will dissipate 800 watts. Thus, for example, if power amplifier PA-2 has been deactivated or removed, then the reject load RL-2 corresponding to that amplifier will dissipate 800 watts. This power level may well appear on any one of the five reject loads RL-1 through RL-N when its corresponding RF power amplifier has been removed or deactivated. Consequently, 800 watts of dissipation must be provided at each reject load RL-1 through RL-N. If separate heat sinks are provided, one for each reject load, then with N=5, there will be five heat sinks, each providing 800 watts of dissipation for a total of 4,000 watts of dissipation capability. It is to be noted that in examining equation (1), the total system reject load dissipation for x=1, 2, 3, 4, and 5 is 800 watts, 1,200 watts, 1,200 watts, 800 watts, and 0 watts, respectively. This shows that a common integrated heat sink system for the reject loads need only have a dissipation capability of 1,200 watts instead of the 4,000 watts as would be required if five individual reject load heat sinks be provided. Consequently, it is seen that a single heat sink need only have the capability of dissipating the heat that would be required if more than one (at least two) of the power amplifiers be deactivated, as by being unplugged or electrically inoperative.

The equation (1) presented hereinbefore has been derived for an ideal combining system where each power amplifier PA-1 through PA-N is delivering equal voltages $V_1$, $V_2$ through $V_n$ to an ideal N-way combiner with the voltages being combined in phase. The output voltage applied to a common load $R_L$ is the scaler sum of the individual input voltages. The derivation of the equation (1) follows below:

$$\text{Power output is } P_o = \frac{\sum_{n=1}^{n} [V_n]^2}{R_L} \quad (2)$$

Then the output power for X inactive amplifiers in the system, taken as a ratio is:

$$\frac{P_o'}{P_o} = \frac{\dfrac{\sum_{n=1}^{n}\sum_{x=1}^{X} [V_n - V_x]^2}{R_L}}{\sum_{N=1}^{n} \dfrac{[V_n]^2}{R_L}} \quad (3)$$

Where $P_o'$ is resulting output power due to X number of deactivated amplifiers. This leads to:

$$\frac{P_o'}{P_o} = \frac{\sum_{N=1}^{n}\sum_{x=1}^{x} [V_n - V_x]^2}{\sum_{n=1}^{n} [V_n]^2} \quad (4)$$

(Where $R_1$ is cancelled out) or simply, power reduction ratio:

$$\frac{P_o'}{P_o} = \left(\frac{n - x}{n}\right)^2 \quad (5)$$

where $V_n$, $V_x$ cancels out by noting: $V_1=V_2=\ldots$ $V_n=V_x$ Defining new terms for N-way, in-phase combiner with reject loads:

n=number of modules
x=number of deactivated modules
Pm=module power
Pd=total reject load dissipation Under normal conditions: (All PA's active)

$$nPm = P_t(\text{total output power}) \quad (6)$$

For X number of deactivated modules use (5).

$$nPm\left(\frac{n - x}{n}\right)^2 = P_t' \text{ reduced power} \quad (7)$$

For total reject load dissipation:

$$(n-x)Pm = P_A(\text{power available after X deactivations}) \quad (8)$$

Then $$P_A - P^l_T = Pd(\text{total reject load dissipation}) \quad (9)$$

substituting (8) into (9):

$$(n-x)Pm - P^l_T = Pd \quad (10)$$

Substituting (7) into (10):

$$(n - x)Pm - nPm\left(\frac{n - x}{n}\right)^2 = Pd \quad (11)$$

Expand and cancel n:

$$(n - x)Pm - Pm(n - x)\frac{(n - x)}{n} = Pd \quad (12)$$

Rearranging $$Pm(n - x)\left(1 - \frac{(n - x)}{n}\right) = Pd \quad (13)$$

Although the invention has been described in conjunction with a preferred embodiment, it is to be appreciated that various modifications may be made without departing from the spirit and scope of the invention as defined by the appended claims.

Having described the invention, the following is claimed:

1. An N-way power combiner/divider comprising:

a common output/input port;

N input/output ports;

N load ports;

N first transmission lines, each having a first characteristic impedance $Z_1$, and each having a first end thereof connected in common and directly to said common output/input port with each opposite second end being connected to a respective one of said N input/output ports;

N second transmission lines, each having a second characteristic impedance $Z_2$, and each having a first end thereof connected to a respective one of said N input/output ports, and each connected at its opposite second end to a respective one of said N load ports;

N third transmission lines, each having a third characteristic impedance $Z_3$, and having a first end thereof connected to a respective one of said N load ports, and the opposite second ends of said third transmission lines being connected together in common defining a common point; and reactance means connecting said common point to electrical ground.

2. A combiner/divider as set forth in claim 1, wherein said reactance means includes capacitive means.

3. A combiner/divider as set forth in claim 2, wherein each of said N first transmission lines has a length equal to one-quarter wavelength a the operating frequency of said combiner/divider.

4. A combiner/divider as set forth in claim 2, wherein each of said N second transmission lines has a length equal to one-quarter wavelength at the operating frequency of said combiner/divider.

5. A combiner/divider as set forth in claim 2, wherein each of said N third transmission lines has a length equal to one-quarter wavelength at the operating frequency of said combiner/divider.

6. A combiner/divider as set forth in claim 2, wherein each of said first, second and third transmission lines has a length equal to one-quarter wavelength at the operating frequency of said combiner/divider

7. A combiner/divider as set forth in claim 1, including N reject loads respectively connecting each of said N load ports to electrical ground.

8. An N-way power combiner/divider comprising:

a common output/input port;

N input/output ports;

N load ports;

N first transmission lines, each having a first characteristic impedance Z1, and each having a first end thereof connected in common and directly to said common output/input port with each opposite second end being connected to a respective one of said N input/output ports;

N second transmission lines, each having a second characteristic impedance Z2, and each having a first end thereof connected to a respective one of said N input/output ports, and each connected at its opposite second end to a respective one of said N load ports;

N third transmission lines, each having a third characteristic impedance Z3, and having a first end thereof connected to a respective one of said N load ports, and the opposite second ends of said third transmission lines being connected together in common defining a common point;

reactance means connecting said common point to electrical ground;

said N first transmission lines each include N coplanar first metal traces mounted on a first insulator board;

said N second transmission lines respectively include N coplanar second metal traces mounted on a second insulator board;

said N third transmission lines include N coplanar third metal traces mounted on a third insulator board;

said first, second and third insulator boards being spaced from each other in parallel planes;

first, second, third and fourth metal planar layers electrically connected together and serving as ground planes, said metal planar layers being spaced from each other and parallel to said first, second and third insulator boards with said first insulator board being located between said first and second layers and said second insulator board being located between said second and third layers and said third insulator board being located between said third and fourth layers.

9. A combiner/divider as set forth in claim 8 including N electrical connecting means, each located at one of said input/output ports, extending between said first and second boards for electrically connecting a respective one of said second ends of said first transmission lines with a first end of one of said N second transmission lines.

10. A combiner/divider as set forth in claim 9, including N reject loads respectively connecting each of said N load ports to electrical ground.

11. A combiner/divider as set forth in claim 10, including N load port connecting means each located at one of said N load ports and extending between said second and third ports for electrically connecting a respective one of said second transmission lines with a respective one of said third transmission lines.

12. An N-way power combiner/divider comprising:

a common output/input port;

a plurality of N input/output ports;

a plurality of N first transmission lines, each having a first end thereof connected in common to said common output/input port, and each having its opposite second end connected to a respective one of said N input/output ports;

a plurality of N second transmission lines, each having a first end thereof connected to a respective one of said N input/output ports;

said N first transmission lines respectively including N coplanar first metal traces mounted on a first insulator board;

said N second transmission lines respectively including N coplanar second metal traces mounted on a second insulator board;

said first and second insulator boards being spaced from each other in parallel planes;

first, second and third metal planar layers electrically connected together, and serving as ground planes, spaced from and parallel to said first and second insulator boards with said first insulator board located between said first and second layers, and said second insulator board being located between said second and third layers;

N electrical connecting means, each located at one of said N input/output ports, extending between said first and second boards for electrically connecting a respective one of said second ends of said first transmission lines with a first end of one of said N second transmission lines;

said second metal layer has an aperture therein in registry with said input/output port, and wherein said electrical connecting means include an electrically-conductive pin extending perpendicularly through said aperture without touching said second metal layer and extending between said first and second insulator boards and making electrical connection at its opposite ends with said second end of one of said N first transmission lines and said first end of one of said N second transmission lines.

13. A combiner/divider as set forth in claim 12, including a third insulator board and a fourth metal planar layer with said third insulator board being spaced from and parallel to said first and second insulator boards and wherein said fourth metal planar layer is electrically connected to said first, second and third metal planar layers and serves as a ground plane and is spaced from and is parallel to said first, second and third insulator boards with said third insulator board being located between said third and fourth metal layers.

* * * * *